US008671814B2

(12) United States Patent
Fujiwara et al.

(10) Patent No.: US 8,671,814 B2
(45) Date of Patent: Mar. 18, 2014

(54) BLAST TREATMENT METHOD AND BLAST TREATMENT DEVICE

(75) Inventors: Shuzo Fujiwara, Tsukuba (JP); Mitsuaki Iida, Tsukuba (JP); Takehiro Matsunaga, Tsukuba (JP); Kenji Koide, Kobe (JP); Ryusuke Kitamura, Kobe (JP)

(73) Assignees: National Institute of Advanced Industrial Science and Technology, Tokyo (JP); Kabushiki Kaisha Kobe Seiko Sho, Kobe-shi (JP)

( * ) Notice: Subject to any disclaimer, the term of this patent is extended or adjusted under 35 U.S.C. 154(b) by 76 days.

(21) Appl. No.: 13/262,433

(22) PCT Filed: Mar. 24, 2010

(86) PCT No.: PCT/JP2010/002067

§ 371 (c)(1),
(2), (4) Date: Sep. 30, 2011

(87) PCT Pub. No.: WO2010/113427

PCT Pub. Date: Oct. 7, 2010

(65) Prior Publication Data

US 2012/0024133 A1 Feb. 2, 2012

(30) Foreign Application Priority Data

Mar. 31, 2009 (JP) ..... 2009-084658

(51) Int. Cl.
*F42B 33/00* (2006.01)

(52) U.S. Cl.
USPC ..... 86/50; 588/403

(58) Field of Classification Search
USPC ..... 86/50; 588/403, 401
See application file for complete search history.

(56) References Cited

U.S. PATENT DOCUMENTS 7,398,720 B2 7/2008 Fujiwara et al.

(Continued)

FOREIGN PATENT DOCUMENTS

JP 2004 324997 11/2004

(Continued)

OTHER PUBLICATIONS

International Preliminary Report on Patentability and Written Opinion issued Nov. 24, 2011 in Application No. PCT/JP2010/002067.

(Continued)

*Primary Examiner* — Michael Carone
*Assistant Examiner* — Reginald Tillman, Jr.
(74) *Attorney, Agent, or Firm* — Oblon, Spivak, McClelland, Maier & Neustadt, L.L.P.

(57) ABSTRACT

A blast treatment method capable of performing blast treatment of a treatment subject with a simple structure, with high efficiency, and at low cost, while inhibiting scattering of harmful substances or the like to the outside. The method includes: inside disposing an inside explosive for blasting a treatment subject around the treatment subject; disposing an outside explosive having a detonation velocity greater than that of the inside explosive at a position outside the inside explosive; and detonating the outside explosive using an initiation device, and initiating the inside explosive by detonation of the outside explosive, thereby performing blast treatment of the treatment subject by initiation of the inside explosive. The outside explosive disposing includes arranging a cord-like explosive member containing the outside explosive and having a shape extending in one direction so that a detonation propagation velocity in a specific direction of the inside explosive initiated by the outside explosive is greater than a detonation propagation velocity in the specific direction of the inside explosive.

9 Claims, 4 Drawing Sheets

(56) References Cited

U.S. PATENT DOCUMENTS

| | | | | |
|---|---|---|---|---|
| 8,006,600 | B2 | 8/2011 | Fujiwara et al. | |
| 2009/0131733 | A1 | 5/2009 | Asahina et al. | |
| 2009/0308235 | A1* | 12/2009 | Lesage et al. | 86/50 |
| 2013/0000469 | A1* | 1/2013 | Murray | 86/50 |

FOREIGN PATENT DOCUMENTS

| | | |
|---|---|---|
| JP | 2005 291514 | 10/2005 |
| JP | 2007 271136 | 10/2007 |
| JP | 2007 309550 | 11/2007 |
| JP | 2008 14595 | 1/2008 |
| WO | WO 2008009745 A1 * | 1/2008 |

OTHER PUBLICATIONS

International Search Report Issued Jul. 13, 2010 in PCT/JP10/002067 filed Mar. 24, 2010.
U.S. Appl. No. 13/262,070, filed Sep. 29, 2011, Koide, et al.
U.S. Appl. No. 13/262,055, filed Sep. 29, 2011, Koide, et al.
U.S. Appl. No. 13/262,419, filed Sep. 30, 2011, Koide, et al.
U.S. Appl. No. 13/262,028, filed Sep. 29, 2011, Koide, et al.
U.S. Appl. No. 13/262,245, filed Sep. 29, 2011, Koide, et al.

* cited by examiner

BLAST TREATMENT METHOD AND BLAST TREATMENT DEVICE

TECHNICAL FIELD

The present invention relates to a blast treatment method and a blast treatment device for performing blast treatment of an object to be blasted such as military ammunition.

BACKGROUND ART

The military ammunition (such as artillery shells, bombs, land mines, and underwater mines) has such a structure that the internal space of a shell made of steel or the like is filled with a bursting charge, for example. The internal space of the shell is filled with, for example, chemical agents, such as mustard gas and lewisite, which are hazardous to human bodies.

The ammunition is treated by blasting, for example. The treatment method by blasting requires no disassembling operation. This provides adaptability to a disposal not only of favorably preserved munitions, for example, but also of munitions hard to disassemble because of its deterioration over time, deformation, or the like. Further, when munitions including chemical agents hazardous to human bodies are treated by the treatment method, most of the chemical agents are decomposed under the ultra-high temperature and ultra-high pressure generated by explosion. An example of such a blast treatment method is disclosed in Patent Document 1.

In the method disclosed in Patent Document 1, a treatment subject is contained in a predetermined container, and an ANFO explosive or the like is disposed around the treatment subject. In addition, a sheet-like explosive having a detonation velocity greater than that of the ANFO explosive is wound around the container. The ANFO explosive is exploded by detonation of the sheet-like explosive, so that the treatment subject is subjected to blast treatment. The detonation vector of the ANFO explosive disposed inside the sheet-like explosive is directed inward by the detonation of the sheet-like explosive. In association with this, the detonation vector of the bursting charge disposed in the shell is directed inward, although the detonation vector is originally directed outward. This results in a reduction in velocity of fragments of the shell scattering to the outside along with the explosion of the bursting charge.

In the conventional blast treatment method, the sheet-like explosive needs to be wound around the container. Accordingly, it is necessary to change the shape of the sheet-like explosive each time according to the size of the container that varies depending on the size of the treatment subject. The sheet-like explosive has to be formed into a predetermined shape depending on the shape of the treatment subject. That is, in the blast treatment method, sheet-like explosives conforming to various shapes of treatment subjects and the like should be prepared. This results in an increase in costs and labor for the preparation.

Patent Document 1: Japanese Patent Application Laid-Open No. 2005-291514

SUMMARY OF THE INVENTION

In view of the above, an object of the present invention is to provide a blast treatment method capable of performing blast treatment with a simple structure, at relatively low cost, and with high efficiency.

In order to achieve this object, a blast treatment method according to the present invention is a blast treatment method for performing blast treatment of a treatment subject including a bursting charge and a shell containing the bursting charge, the blast treatment method including: an inside explosive disposing step of disposing an inside explosive for blasting the treatment subject around the treatment subject; an outside explosive disposing step of disposing an outside explosive having a detonation velocity greater than that of the inside explosive at a position outside the inside explosive; and a blast step of initiating the outside explosive using an initiation device, and initiating the inside explosive by detonation of the outside explosive, thereby performing blast treatment of the treatment subject by detonation of the inside explosive. The outside explosive disposing step includes an arrangement step of arranging a cord-like explosive member containing the outside explosive and having a shape extending in one direction so that a detonation propagation velocity in a specific direction of the inside explosive initiated by the outside explosive is greater than a detonation propagation velocity in the specific direction of the inside explosive.

According to this method, even if the size and shape of the treatment subject are changed, adaptability to various treatment subjects can be obtained only by changing a mode of arranging the cord-like explosive member. Further, the detonation propagation velocity in the specific direction of the inside explosive can be increased while inhibiting scattering of fragments or the like of the treatment subject. This leads to an increase in efficiency of the blast treatment and a reduction in costs.

EMBODIMENTS FOR CARRYING OUT THE INVENTION

Figure 1:
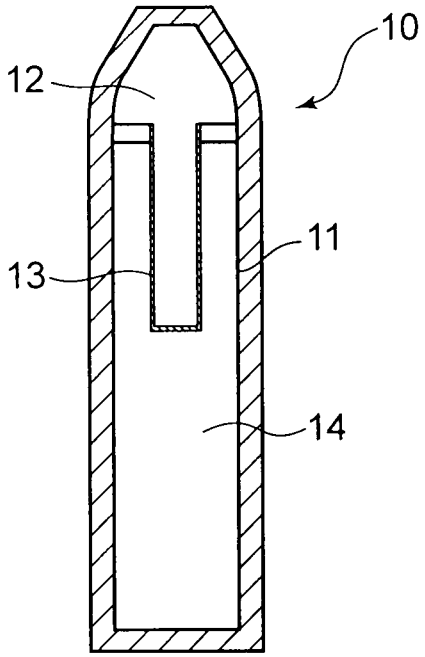
FIG. 1 is a sectional view showing an example of an object to be subjected to blast treatment by a blast treatment method according to the present invention.
Figure 2:
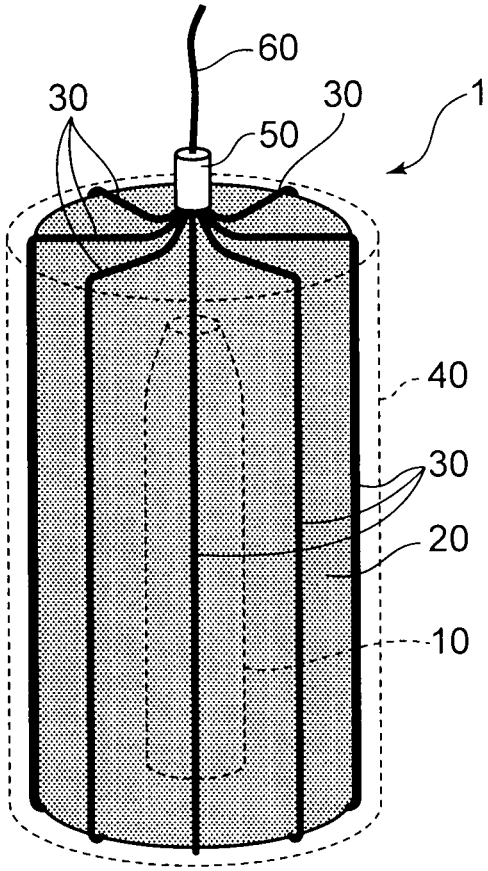
FIG. 2 is a schematic perspective view showing a state where the treatment subject shown in FIG. 1 is mounted in a blast treatment device using the blast treatment method according to the present invention.
Figure 3:
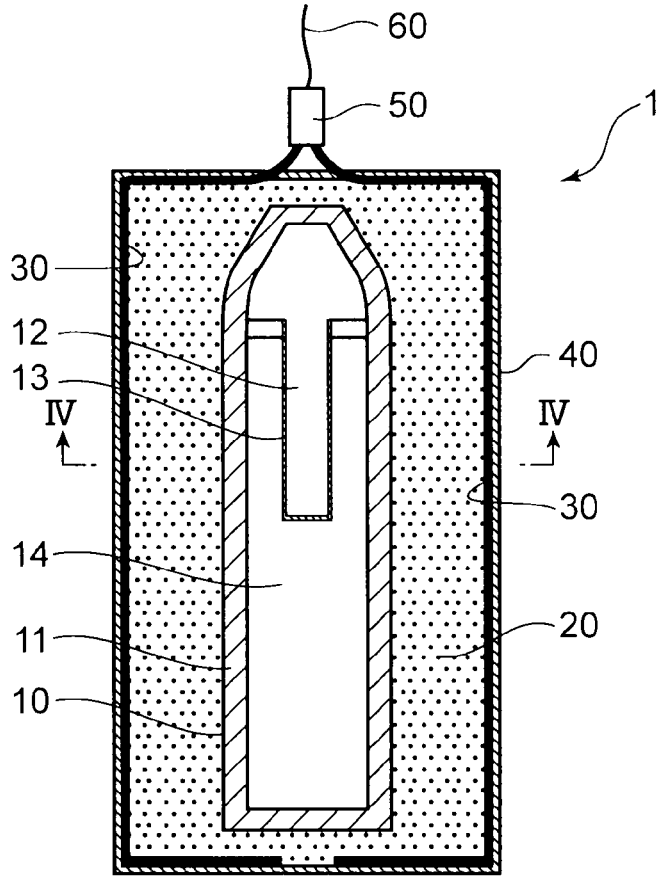
FIG. 3 is a longitudinal sectional view of the state shown in FIG. 2.
Figure 4:
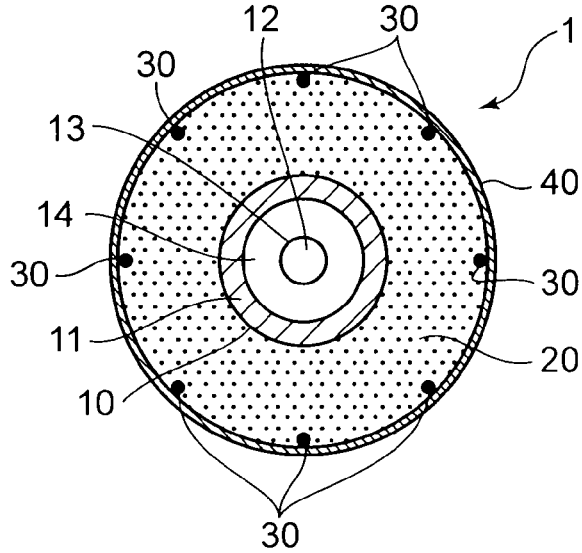
FIG. 4 is a sectional view taken along the line IV-IV of FIG. 3.

Hereinafter, an embodiment of a blast treatment method according to the present invention will be described with reference to the drawings. FIG. 1 is a sectional view of a chemical bomb 10, which is a chemical weapon, as an exemplary object to be subjected to blast treatment by the blast treatment method. FIG. 2 is a perspective view of a blast treatment device 1 used for the blast treatment method. FIG. 3 is a longitudinal sectional view of the blast treatment device 1. FIG. 4 is a cross-sectional view of the blast treatment device 1 taken along the line IV-IV of FIG. 3.

As shown in FIG. 1, the chemical bomb 10 includes a shell 11 made of steel and a burster tube 13. The shell 11 and the burster tube 13 extend in a predetermined direction. The chemical bomb 10 extends in the axial direction of the shell 11 and the burster tube 13.

The burster tube 13 contains a bursting charge 12. The bursting charge 12 is made of picric acid, TNT, or the like. A chemical agent 14 is contained between the shell 11 and the burster tube 13. In the chemical bomb 10, the bursting charge 12 explodes by being initiated by a fuze, which is not shown, and the shell 11 is broken, so that the chemical agent 14 as well as fragments of the shell 11 are scattered around.

The blast treatment method is a method for performing blast treatment of the chemical bomb 10 as described above to render it harmless. In the blast treatment method, as shown in FIG. 2 and the like, blast treatment is performed using the blast treatment device 1 including inside explosive 20, a plurality of cord-like explosive members 30, a container 40, and an electric detonator (initiation device) 50.

The inside explosive 20 is an explosive for detonating and blasting the chemical bomb 10. The cord-like explosive members 30 each include an outside explosive 34 for initiating the inside explosive 20. The cord-like explosive members 30 each have a shape extending in one direction. The container 40 is used to contain the chemical bomb 10, the inside explosive 20, and the cord-like explosive members 30. The electric detonator 50 is used to initiate the outside explosive 34.

The blast treatment method includes the following steps.

1) Outside Explosive Disposing Step

This step is a step of disposing the outside explosive 34 at a position outside the inside explosive 20. This step includes the following step.

1-1) Cord-like Explosive Member Forming Step

This step is a step of forming each cord-like explosive member 30.

Figure 5:
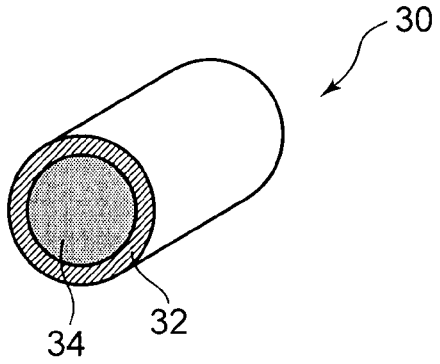
FIG. 5 is an explanatory view showing an exemplary cord-like explosive member used for the blast treatment device shown in FIG. 2.

In this embodiment, a string-like detonating cord with the covered powder core, i.e., the outside explosive 34, of PETN, is used as each cord-like explosive member 30. As shown in FIG. 5, each cord-like explosive member 30 includes an external cylinder 32 and the outside explosive 34 made of PETN contained in the external cylinder 32. The external cylinder 32 is made of plastic or the like extending in one direction. The cord-like explosive member 30 thus formed has a detonation velocity of about 7 km/s.

In the cord-like explosive member forming step, a long string-like detonating cord prepared in advance is cut according to the size and shape of the container 40, thereby forming the plurality of cord-like explosive members 30. In this embodiment, eight cord-like explosive members 30 having the same length are formed from the detonating cord.

1-2) Arrangement Step

This step is a step of arranging the cord-like explosive members 30 at positions outside the inside explosive 20.

In this step, as shown in FIG. 2, the eight cord-like explosive members 30 are arranged at equal intervals in parallel with the central axis of the container 40 on the internal surface of the container 40 having a substantially cylindrical shape. The eight cord-like explosive members 30 are symmetric to each other with respect to the central axis of the container 40. The cord-like explosive members 30 thus arranged on the internal surface of the container 40 are bundled into one on the central axis of the container 40.

The container 40 may have any structure as long as it can maintain the shape of the inside explosive 20, which is described later, when the inside explosive 20 is filled in the container 40. The container 40 may have form stability like a case made of hard resin, or may be formed of a flexible bag body, for example.

2) Inside Explosive Disposing Step

This step is a step of disposing the inside explosive 20 around the chemical bomb 10.

In this step, the chemical bomb 10 is first contained in substantially the center of the container 40 so that the axis line of the chemical bomb 10 and the central axis of the container 40 match each other. At this time, the eight cord-like explosive members 30 oppose each other with the chemical bomb 10 interposed therebetween.

Next, the inside explosive 20 is poured between the chemical bomb 10 and the container 40. The inside explosive 20 is disposed around the chemical bomb 10. The shape of the poured inside explosive 20 is maintained in the same shape (a substantially cylindrical shape in this case) as the container 40.

As described above, the inside explosive 20 is explosives for detonating and blasting the chemical bomb 10. Any kind of explosives can be used as the inside explosive 20 as long as they have a detonation velocity smaller than that of the outside explosive 34. However, a powder material or a fluid material having fluidity, such as an emulsion explosive, a slurry explosive, or an ANFO explosive, may be preferably used as the inside explosive 20. Each of the emulsion explosive and the slurry explosive has a detonation velocity of about 5 km/s, and the ANFO explosive has a detonation velocity of about 3 km/s. The detonation velocity of the outside explosive 34 is much greater than the detonation velocity of the inside explosive 20. In the subsequent blast step, when the outside explosive 34 and the inside explosive 20 is initiated the propagation velocity of the detonation of the inside explosive 20 in a direction from the electric detonator 50, which is described later, along the cord-like explosive members 30, i.e., in a direction along the central axis of the container 40, is greater than the detonation velocity of the inside explosive 20.

3) Blast Step

This step is a step of initiating the outside explosives 34 contained in the cord-like explosive members 30, and initiating the inside explosive 20 by the detonation of the outside explosive 34, thereby performing blast treatment of the chemical bomb 10 by detonation forces of the inside explosive 20.

In this step, the electric detonator 50 is commonly connected to the cord-like explosive members 30. Specifically, the electric detonator 50 is connected to a bundle of the cord-like explosive members 30 which are bundled into one on the central axis of the inside explosive 20. At this time, the electric detonator 50 is connected in such a manner that distances from each connecting point between the cord-like explosive members 30 and the electric detonator 50, i.e., each initiation point of the outside explosives 34, to the outer peripheral surface of the inside explosive 20 are equal to each other.

Next, the electric detonator 50 is connected to a firing device, which is not shown, via a firing cable 60.

This firing device is manipulated to allow the electric detonator 50 to simultaneously initiate all the outside explosives 34 contained in the plurality of cord-like explosive members 30. The detonation of the outside explosives 34 causes the inside explosive 20 to be initiated. The detonation of the inside explosive 20 allows blast treatment of the chemical bomb 10.

Specifically, the detonation of the outside explosives 34 is first propagated to the outside in the radial direction. After that, the detonation of the outside explosive 34 is propagated from one end of the inside explosive 20 to the other end thereof with the outer peripheral surface of the inside explosives 20 being in parallel with the central axis of the inside explosives 20. The distances from each initiation point of the outside explosives 34 to the outer peripheral surface of the inside explosives 20 are equal to each other. Accordingly, detonation waves of the outside explosives 34 contained in the cord-like explosive members 30 are concentrically propagated toward the outside in the radial direction on the outside of the inside explosive 20. After that, the detonation waves are propagated in parallel to each other on the outer peripheral surface of the inside explosive 20.

The detonation waves of the outside explosives 34 are propagated to the inside explosive 20 disposed in the vicinity of the outside explosives 34. Upon receiving the detonation waves of the outside explosives 34, the inside explosive 20 start to detonate. The propagation of the detonation of the inside explosive 20 follows the propagation of the detonation of the outside explosives 34, because outer peripheral portions of the inside explosive 20 are initiated by the outside explosives 34 and the detonation velocity of the outside explosives 34 is greater than the detonation velocity of the inside explosive 20.

As described above, the detonation of the outside explosives 34 contained in the cord-like explosive members 30 are propagated in parallel to each other on the outer peripheral surface of the inside explosive 20. Thus, the outer peripheral portions on a cross section perpendicular to the central axis of the inside explosive 20 are simultaneously initiated.

In this embodiment, as shown in FIG. 2 and the like, the cord-like explosive members 30 containing the outside explosives 34 are arranged on the outer peripheral surface of the inside explosive 20 at intervals, and the intervals therebetween are set to dimensions in which the outer peripheral portions of the inside explosive 20 are simultaneously initiated. Accordingly, in the periphery of the treatment subject 10, the outer peripheral portions of the inside explosive 20 are substantially simultaneously initiated over the perimeter thereof. The intervals are set to be substantially equal to or less than the thickness in the radial direction of the inside explosive 20.

The inside explosive 20 is maintained in a cylindrical shape with the chemical bomb 10 being located at a substantial center. Accordingly, as described above, when the outer peripheral portions of the inside explosive 20 are simultaneously initiated, the detonation forces of the inside explosive 20 provided around the chemical bomb 10 are intensively applied to the chemical bomb 10.

Thus, upon receiving the detonation forces of the inside explosive 20, the bursting charge 12 of the chemical bomb 10 is detonated to break the shell 11, and the chemical agent 14 is decomposed under the ultra-high temperature and ultra-high pressure, thereby treating the chemical bomb 10. When the bursting charge 12 is initiated, fragments of the shell 11 and the like are to be scattered to the outside. However, the fragments receive an inward force by the detonation of the inside explosive 20, and the scattering velocity of the fragments to the outside is suppressed to a low level.

In the case of performing blast treatment of a plurality of chemical bombs 10, the steps from the outside explosive disposing step to the blast step are repeated. In this case, even if a new chemical bomb 10 has a shape different from that of the chemical bomb 10 which has already been treated, the cord-like explosive members can be commonly used. That is, in the cord-like explosive member forming step, the detonating cord is cut into a length conforming to the new chemical bomb 10, thereby obtaining the cord-like explosive members 30 conforming to various chemical bombs 10 having different shapes.

As described above, according to the blast treatment method, the outside explosives 34 having a greater detonation velocity are disposed outside the inside explosive 20, and the outside explosives 34 initiate the inside explosive 20, thereby inhibiting fragments of the chemical bomb 10 and the like from scattering to the outside.

Particularly, in this method, the cord-like explosive members 30 containing the outside explosives 34 and having a shape extending in one direction are arranged outside the inside explosive 20, and the outside explosives 34 are disposed outside the inside explosive 20. This facilitates adaptability to a change in the size and shape of the chemical bomb 10. That is, the common cord-like explosive members 30 can be used even if the size and shape of the chemical bomb 10 are changed, which eliminates the need for preparing explosive members with shapes conforming to the shapes of various chemical bombs 10. This improves the efficiency of the blast treatment and reduces costs.

The plurality of cord-like explosive members 30 are arranged outside the inside explosive 20, and the inside explosive 20 is simultaneously initiated by the outside explosives 34 at a plurality of points, thereby inhibiting scattering of the fragments of the chemical bomb 10 to the outside from a plurality of directions. This reliably inhibits scattering of the fragments and the like.

The common electric detonator 50 initiates the outside explosives 34 contained in the plurality of cord-like explosive members 30, thereby uniformly detonating the inside explosive 20 by one-time initiation.

The plurality of cord-like explosive members 30 are arranged along a predetermined direction, and the detonation of each of the outside explosives 34 contained in the plurality of cord-like explosive members 30 is propagated along the predetermined direction. The chemical bomb 10 is sequentially blasted along the propagating direction. This increases the efficiency of the blast treatment of the chemical bomb 10.

The plurality of cord-like explosive members 30 are arranged at positions opposing each other with the chemical bomb 10 interposed therebetween, and the outside explosives 34 contained in the opposing cord-like explosive members 30 are simultaneously detonated, thereby simultaneously detonating the outer peripheral portions of the inside explosive 20. Thus, the impulsive force generated by the inside explosive 20 is concentrated on the chemical bomb 10. This reliably inhibits scattering of fragments of the chemical bomb 10 to the outside.

The plurality of the cord-like explosive members 30 are arranged at equal intervals, and the inside explosive 20 is uniformly initiated. This leads to a reduction in the number of the cord-like explosive members 30 and a reduction in costs.

The inside explosive 20 is disposed in a substantially cylindrical shape with the chemical bomb 10 being located at a substantial center. The plurality of cord-like explosive members 30 are arranged along the outer peripheral surface of the inside explosive 20 from one end toward the other end in the central axis direction of the inside explosive 20. Further, the outside explosives 34 contained in the cord-like explosive members 30 are simultaneously detonated on a cross section perpendicular to the central axis of the inside explosive 20. Accordingly, the inside explosive 20, which is disposed at substantially equal intervals with respect to the chemical bomb 10, are sequentially initiated. This allows the detonation force of the inside explosive 20 to be concentrated on the chemical bomb 10, thereby increasing the efficiency of the blast treatment of the chemical bomb 10.

Herein, the number of the cord-like explosive members 30 is not limited to eight.

In the embodiment described above, the outside explosives 34 (PETN) are used as a powder core and the detonating cord covered with the external cylinder 32 made of plastic or the like is used as the cord-like explosive members 30. However, the outside explosive 34 and the external cylinder 32 are not limited to those described above. Furthermore, the structure of each of the cord-like explosive members 30 is not limited to that described above. For example, a cord-like member formed of a composition C-4, an element obtained by forming a sheet-like explosive member containing an explosive such as PETN into a tape shape, or the like may be used as the cord-like explosive members 30. The type of the inside explosive 20 is also not limited to that described above.

In the embodiment described above, the container 40 has a cylindrical shape, but the shape of the container 40 is not limited to this. Furthermore, the container 40 may be omitted, and flexible explosives may be used as the inside explosive 20. In this case, for example, the inside explosive 20 having flexibility are fixed around the chemical bomb 10, and the cord-like explosive members 30 are directly arranged to the outer periphery of the inside explosive 20. The inside explosive 20 may be packed into a plurality of bags, and the bags containing the inside explosive 20 may be mounted around the chemical bomb 10. The outside explosives 34 may be arranged around these bags.

Figure 6:
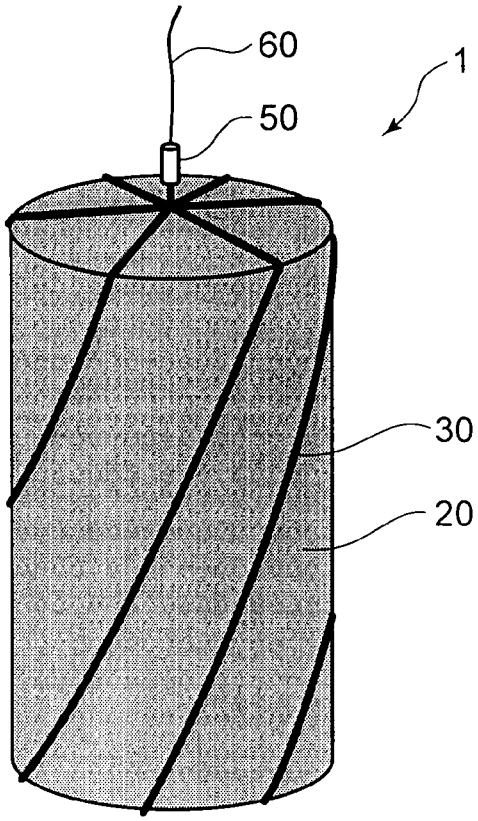
FIG. 6 is a schematic perspective view showing another embodiment of the blast treatment device used for the blast treatment method according to the present invention.

The mode of arranging the outside explosive 34 is not limited to that described above. For example, as shown in FIG. 6, the outside explosives 34 may be obliquely arranged outside the inside explosive 20.

The treatment subject by the blast treatment method is not limited to the chemical bomb 10 as described above. The types of the bursting charge, the chemical agent, and the like disposed in the chemical bomb 10 are not limited to those described above. The blast treatment method may be used to perform blast treatment of ammunitions including an explosive, such as TNT, picric acid, or RDX, a blister agent, such as mustard gas, or lewisite, a sneezing agent, such as DC or DA, and a chemical agent, such as phosgene, sarin, or hydrocyanic acid. The blast treatment method may also be used to treat only a bursting charge portion obtained after dismantling of a chemical bomb, or ammunitions containing no chemical agent, for example.

As described above, the present invention provides a blast treatment method for performing blast treatment of a treatment subject including a bursting charge and a shell containing the bursting charge, the blast treatment method including: an inside explosive disposing step of disposing an inside explosive for blasting the treatment subject around the treatment subject; an outside explosive disposing step of disposing an outside explosive having a detonation velocity greater than that of the inside explosive at a position outside the inside explosive; and a blast step of initiating the outside explosive using an initiation device, and initiating the inside explosive by detonation of the outside explosive, thereby performing blast treatment of the treatment subject by detonation of the inside explosive. The outside explosive disposing step includes an arrangement step of arranging a cord-like explosive member containing the outside explosive and having a shape extending in one direction so that a detonation propagation velocity in a specific direction of the inside explosive initiated by the outside explosive is greater than a detonation propagation velocity in the specific direction of the inside explosive.

According to this method, the outside explosive having a greater detonation velocity is disposed outside the inside explosive, and the outside explosive initiated the inside explosive. The inside explosive is initiated by the outside explosive prior to the initiation caused by the detonation propagated from another inside explosive previously initiated. As a result, the detonation vector of the inside explosive is directed inward. This inhibits scattering of fragments of the treatment subject and the like to the outside of the inside explosive.

In particular, the cord-like explosive member having a shape extending in one direction is arranged outside the inside explosive, so that the outside explosive is disposed outside the inside explosive. Therefore, even if the size and shape of the treatment subject are changed, the outside explosive can be easily disposed for various treatment subjects, by changing the mode of arranging the cord-like explosive member. That is, even if the size and shape of the treatment subject are changed, common cord-like explosive members can be used. This eliminates the need for preparing explosive members having a plurality of shapes conforming to a plurality of shapes of various treatment subjects so as to dispose the outside explosive. This increases the efficiency of the blast treatment and reduces costs.

Moreover, the detonation propagation velocity in the specific direction of the outside explosive is greater than the detonation propagation velocity in the specific direction of the inside explosive. Accordingly, the inside explosive is detonated after the detonation of the outside explosives, which allows the detonation vector of the inside explosive to be reliably directed inward. The detonation propagation velocity in the specific direction of the inside explosive increases along with the detonation velocity of the outside explosives. This increases the efficiency of the blast treatment.

According to the present invention, it is preferable that in the arrangement step, the plurality of the cord-like explosive members be arranged at positions outside the inside explosive. It is also preferable that in the blast step, the outside explosives contained in the plurality of cord-like explosive members be simultaneously detonated at a plurality of points.

According to this method, the outside explosive is simultaneously detonated at a plurality of points, and the inside explosive is simultaneously initiated at a plurality of points. At the plurality of points, the detonation vectors of each inside explosive are simultaneously directed inward. This allows the detonation vectors of each inside explosive to be concentrated on the treatment subject, and reliably inhibits scattering of fragments of the treatment subject to the outside. Provision of a plurality of outside explosives increases the number of detonation waves of the outside explosive to be propagated to the inside explosive, and increases the detonation propagation velocity of the inside explosive.

In this case, it is preferable that in the blast step, the plurality of cord-like explosive members be connected to a common initiation device and the outside explosives contained in the plurality of cord-like explosive members be simultaneously initiated. Thus, the blast treatment is completed by a smaller number of times of initiation.

It is preferable that in the arrangement step, the plurality of cord-like explosive members be arranged along a predetermined direction. It is also preferable that in the blast step, the detonation of each of the outside explosives contained in the plurality of cord-like explosive members be propagated along the predetermined direction.

Thus, the detonation of the inside explosive advances in one direction along the treatment subject, and the treatment subject is sequentially blasted along this direction. Consequently, the treatment subject can be effectively treated.

It is preferable that in the arrangement step, at least part of the plurality of cord-like explosive members be arranged at positions opposing each other with the treatment subject interposed therebetween. It is also preferable that in the blast step, the outside explosives contained in the opposing cord-like explosive members be simultaneously detonated.

According to this method, the parts of the inside explosive disposed at positions opposing each other are simultaneously initiated by the detonation of the outside explosives. As a result, the detonation vector of the inside explosive can be reliably concentrated on the treatment subject. This further increases the efficiency of the blast treatment of the treatment subject, and more reliably inhibits scattering of fragments of the treatment subject to the outside.

It is preferable that in the arrangement step, the plurality of cord-like explosive members be arranged at equal intervals. With this structure, the inside explosive can be uniformly initiated and the treatment subject can be efficiently blasted with a smaller number of cord-like explosive members.

It is preferable that in the inside explosive disposing step, the inside explosive be disposed in a substantially cylindrical shape with the treatment subject being located at a substantial center. Further, it is preferable that in the arrangement step, the plurality of cord-like explosive members be arranged at positions along the outer peripheral surface of the inside explosive from one end toward the other end in the central axis direction of the inside explosive. Furthermore, it is preferable that in the blast step, the plurality of cord-like explosive members be connected to a common initiation device on the central axis of the inside explosive, and the outside explosives contained in the plurality of cord-like explosive members be simultaneously detonated on a cross section perpendicular to the central axis of the inside explosive.

In this method, the parts of the inside explosive disposed at substantially equal distances with respect to the treatment subject, among the inside explosive, are sequentially initiated by the detonation of the outside explosives. As a result, the detonation forces of the inside explosive disposed around the treatment subject are concentrated on the treatment subject. This further increases the efficiency of the blast treatment of the treatment subject, and reliably inhibits scattering of fragments of the treatment subject to the outside.

It is preferable that in the inside explosive disposing step, the treatment subject be put into a predetermined container; the inside explosive having fluidity be used as the inside explosive to be disposed around the treatment subject; and the inside explosive having fluidity be disposed between the internal surface of the container and the treatment subject. In this method, the inside explosive having fluidity is stably disposed around the treatment subject.

Further, it is preferable that the arrangement step be carried out prior to the inside explosive disposing step. Furthermore, it is preferable that in the arrangement step, the cord-like explosive member be arranged on the internal surface of the container before the inside explosive is disposed in the container.

Thus, the inside explosive having fluidity and the outside explosives are stably disposed in the container. Moreover, the inside explosive and the cord-like explosive member are in direct contact with each other, which allows the detonation waves of the outside explosives contained in the cord-like explosive member to be efficiently propagated.

According to the present invention, it is preferable that the outside explosive disposing step include a step of forming the cord-like explosive member by cutting, into a predetermined length, a cord-like object having a shape extending in one direction and containing the outside explosive. It is also preferable that in the outside explosive disposing step, the cord-like explosive member thus formed be arranged at positions outside the inside explosive.

In this method, the cord-like explosive member is formed only by cutting the cord-like object into a predetermined length. The cord-like explosive member thus formed is arranged at positions outside the inside explosive, so that the outside explosives are disposed outside the inside explosive. This facilitates adaptability to various treatment subjects only by changing the length of the cord-like object to be cut, even if the size and shape of the treatment subject are changed.

The present invention also provides a blast treatment device including: an inside explosive disposed outside the treatment subject and used for blasting the treatment subject; a cord-like explosive member containing an outside explosive having a detonation velocity greater than that of the inside explosive, and having a shape extending in one direction; and an initiation device connected to the cord-like explosive member and used for initiating the outside explosive contained in the cord-like explosive member. The cord-like explosive member is arranged around the inside explosive so that the inside explosive is initiated by detonation of the outside explosive and a detonation propagation velocity in the specific direction of the inside explosive initiated by the outside explosive is greater than a detonation propagation velocity of the inside explosive.

This device has such a simple structure that the cord-like explosive member containing the outside explosive with a detonation velocity greater than that of the inside explosive and having a shape extending in one direction are arranged around the inside explosive, inhibits scattering of fragments of the treatment subject and the like to the outside, and facilitates adaptability to various treatment subjects having various shapes. This increases the safety of the treatment and increases the efficiency of the treatment.

In the blast treatment device, it is preferable that the plurality of cord-like explosive members be arranged at equal intervals along a predetermined direction outside the inside explosive, and that the plurality of cord-like explosive members be connected to a common initiation device.

In this structure, the plurality of cord-like explosive members are initiated with a smaller number of initiation devices. Further, the inside explosive is sequentially detonated uniformly along a predetermined direction by detonation of the outside explosives contained in the cord-like explosive members. The detonation forces of the inside explosive are efficiently applied to the treatment subject.

The blast treatment device includes a container capable of containing the treatment subject. The inside explosive has fluidity, and the cord-like explosive members is arranged on an internal surface of the container. In addition, the inside explosive having fluidity is contained between the internal surface of the container and the treatment subject.

In this manner, the inside explosive having fluidity and the cord-like explosive member are stably disposed in the container. Furthermore, the inside explosive and the cord-like explosive member are in direct contact with each other, so that the detonation waves of the outside explosives contained in the cord-like explosive member is effectively propagated to the inside explosive.

The invention claimed is:

1. A blast treatment method for performing blast treatment of a treatment subject including a bursting charge and a shell containing the bursting charge, the blast treatment method comprising:

an inside explosive disposing step of disposing an inside explosive for blasting the treatment subject around the treatment subject;

an outside explosive disposing step of disposing an outside explosive having a detonation velocity greater than that of the inside explosive, at a position outside the inside explosive; and a blast step of initiating the outside explosive using an initiation device, and initiating the inside explosive by detonation of the outside explosive, thereby performing blast treatment of the treatment subject by detonation of the inside explosive, wherein the outside explosive disposing step includes an arrangement step of arranging more than two cord shaped explosive members being spaced at intervals about the circumference of the treatment subject, wherein all of said intervals spacing all of said cord shaped explosive members are equal to one another, the cord shaped explosive members each containing the outside explosive and each having a shape extending in a predetermined direction at positions outside the inside explosive so that a detonation propagation velocity in the predetermined direction of the inside explosive initiated by the outside explosive is greater than a detonation propagation velocity in the predetermined direction of the inside explosive;

and wherein, in the blast step, the outside explosives contained in the cord shaped explosive members are simultaneously detonated, and the detonation of each of the outside explosives is propagated in the predetermined direction.

2. The blast treatment method according to claim 1, wherein in the blast step, the cord shaped explosive members are connected to a common initiation device, and the initiation device simultaneously initiates the outside explosives contained in the cord shaped explosive members.

3. The blast treatment method according to claim 1, wherein in the arrangement step, at least part of the cord shaped explosive members are arranged at positions opposing each other with the treatment subject interposed therebetween, and in the blast step, the outside explosives contained in the opposing cord shaped explosive members are simultaneously detonated.

4. The blast treatment method according to claim 1, wherein in the inside explosive disposing step, the inside explosive is disposed in a substantially cylindrical shape with the treatment subject being located at a substantial center, in the arrangement step, the cord shaped explosive members are arranged at positions along an outer peripheral surface of the inside explosive from one end toward the other end in a central axis direction of the inside explosive, and in the blast step, the cord shaped explosive members are connected to a common initiation device on a central axis of the inside explosive, and the outside explosives contained in the cord shaped explosive members are simultaneously detonated on a cross section perpendicular to the central axis of the inside explosive.

5. The blast treatment method according to claim 1, wherein in the inside explosive disposing step, the treatment subject is put into a predetermined container, and the inside explosive disposed around the treatment subject has fluidity, the inside explosive having fluidity being disposed between an internal surface of the container and the treatment subject.

6. The blast treatment method according to claim 5, wherein the arrangement step is carried out prior to the inside explosive disposing step, and in the arrangement step, the cord shaped explosive members are arranged on the internal surface of the container before the inside explosive is disposed in the container.

7. The blast treatment method according to claim 1, wherein the outside explosive disposing step includes a step of forming each of the cord shaped explosive members by cutting, into a predetermined length, a cord shaped object containing the outside explosive and having a shape extending in one direction, and in the outside explosive disposing step, the cord shaped explosive members thus formed are arranged at positions outside the inside explosive in the arrangement step.

8. A blast treatment device for performing blast treatment of a treatment subject including a bursting charge and a shell containing the bursting charge, the blast treatment device comprising:

an inside explosive configured to be disposed outside the treatment subject and used for blasting the treatment subject;

more than two cord shaped explosive members arranged at intervals about the circumference of the treatment subject, the cord shaped explosive members being spaced at intervals about the circumference of the treatment subject, wherein all of said intervals spacing all of said cord shaped explosive members are equal to one another, the cord shaped explosive members each containing an outside explosive having a detonation velocity greater than that of the inside explosive, and each having a shape extending in a predetermined direction at positions outside the inside explosive; and a common initiation device connected to the cord shaped explosive members and used for initiating the outside explosives contained in the cord shaped explosive members so that the outside explosives are simultaneously detonated and the detonation of each of the outside explosives is propagated in the predetermined direction, wherein the cord shaped explosive members are arranged around the inside explosive so that the inside explosive is initiated by detonation of the outside explosive and a detonation propagation velocity in the predetermined direction of the inside explosive initiated by the outside explosive is greater than a detonation propagation velocity in the predetermined direction of the inside explosive.

9. The blast treatment device according to claim 8, further comprising a container capable of containing the treatment subject, wherein the inside explosive has fluidity, the cord shaped explosive members are arranged on an internal surface of the container, and the inside explosive having fluidity is contained between the internal surface of the container and the treatment subject.

* * * * *